US005329896A

United States Patent [19]

Everts

[11] Patent Number: 5,329,896

[45] Date of Patent: Jul. 19, 1994

[54] REPLACEABLE RECOIL STARTER

[75] Inventor: Robert G. Everts, Chandler, Ariz.

[73] Assignee: Ryobi Outdoor Products, Inc., Chandler, Ariz.

[21] Appl. No.: 1,298

[22] Filed: Jan. 6, 1993

[51] Int. Cl.[5] ..... F02N 3/02

[52] U.S. Cl. ..... 123/185.3

[58] Field of Search ..... 123/185.3, 185.2, 185.4

[56] References Cited

U.S. PATENT DOCUMENTS

| | | | |
|---|---|---|---|
| H517 | 9/1988 | Sato et al. | 123/185.3 |
| 2,564,787 | 8/1951 | Mack | 123/185.3 |
| 2,730,092 | 1/1956 | Reif | 123/185.3 |
| 2,868,186 | 1/1959 | Schnacke | 123/185.3 |
| 2,926,648 | 3/1960 | Hamman | 123/185.3 |
| 3,306,277 | 2/1967 | Gudmundsen | 123/185.3 |
| 4,732,121 | 3/1988 | Miyata et al. | 123/185.3 |
| 4,821,691 | 4/1989 | Ueno et al. | 123/185.3 |

*Primary Examiner*—Andrew M. Dolinar

*Attorney, Agent, or Firm*—Brooks & Kushman

[57] ABSTRACT

A replaceable starter assembly for a hand-held internal combustion engine of a power tool is disclosed. The replaceable starter assembly comprises a cartridge including a spool on which rope is wound and with a recoil spring for biasing the spool to rotate in one direction. The cartridge is secured to an engine housing of the power tool on the opposite side of the engine housing from the internal combustion engine. The cartridge may be detached from the engine housing of the power tool to facilitate the replacement of the starter assembly without requiring disassembly of the engine housing of the power tool. A starter housing substantially encloses the cartridge and is secured to the engine housing by removable fasteners. The starter housing may include a clutch and clutch drum which are removable with the starter housing and separable from the cartridge. The starter assembly is assembled to the power tool between the engine housing and a boom which supports the driveshaft of an implement.

13 Claims, 3 Drawing Sheets

REPLACEABLE RECOIL STARTER

TECHNICAL FIELD

The present invention relates to a recoil starter assembly for a hand-held internal combustion engine and more particularly relates to a replaceable cartridge recoil starter.

BACKGROUND OF INVENTION

Recoil starters are used to manually start small internal combustion engines. The best known example of a recoil starter is a lawn mower starter. The use of small internal combustion engines having recoil starters has increased in recent years. Such engines are used on hand-held lawn care implements such as line trimmers, blowers, edgers and cultivators. The recoil starter is a relatively frequent maintenance item on such lawn care implements. One problem that may occur is that the pull rope may become disengaged from the rope spool. Another cause for repair of the recoil starter is breakage or jamming of the recoil spring. Another maintenance detail is wear of the starter gear.

In recent years, the weight and cost of internal combustion engines for hand-held implements has been reduced by providing a half-crank internal combustion engine. An example of this is shown in U.S. Pat. No. 4,356,605, in which a single cylinder is connected to a half-crank crankshaft. In this type of engine, a recoil starter is secured to the forward end of the internal combustion engine at the location where the crank is journalled for rotation. It is not possible to secure the recoil starter to the rear portion of the crankshaft because the crank does not extend through the rear of the internal combustion engine.

Prior art recoil starter devices include statutory invention registration H517 to Sato et al, which discloses a recoil starter having a rope which may be replaced by removing a cover on the recoil case without detaching the recoil drum and spiral spring. The recoil pulley is exposed when the recoil cover is removed from the recoil case. A new rope may be wound on the periphery of the recoil pulley without detaching the recoil pulley from the engine. While this simplifies the approach to repair or replacement of the recoil rope, it is not suited for half-crank internal combustion engines and does not provide a simple method for replacing the recoil spring which drives the rope to a return position.

U.S. Pat. No. 4,732,121 to Miyata et al, describes a recoil starter with a side plate disposed between the recoil spring and the rope spool. The side plate is used to retain the recoil spring when the rope spool is removed for replacement or inspection. This design is again not useful with a half-crank internal combustion engine because it is secured to the rear of the internal combustion engine. Also, no method of simply replacing the recoil spring is provided by this reference.

U.S. Pat. No. 2,926,648 to Hamman discloses a recoil starter assembly which may be disassembled by an operator to replace the rope and make other repairs. This approach is not well suited for a half-crank engine and is subject to many of the disadvantages and complex maintenance procedures which are representative of the prior art.

These and other problems and disadvantages encountered by prior art recoil starter assemblies are addressed by the applicant's invention as summarized below.

SUMMARY OF INVENTION

It is an object of the invention to provide a simple, inexpensive and readily serviceable recoil starter assembly. To this end, a cartridge having a spool around which a starter rope is wound and which is biased to recoil by a recoil spring is provided. The cartridge is removable from an internal combustion engine housing without disassembly of the engine housing.

It is another object of the invention to provide a replaceable recoil starter assembly for a half-crank internal combustion engine which is mounted on an internal combustion engine between the engine shaft and the power take-off shaft of an implement.

It is yet another object of the invention to provide a replaceable recoil starter assembly which allows replacement of the rope, spool, recoil spring and starter gear together as a unitary apparatus.

According to the invention, a replaceable starter assembly for an internal combustion engine of a hand-held power tool having an engine housing is provided. The replaceable starter assembly is in the form of a cartridge housing a spool upon which a rope is wound. A recoil spring biases the spool for rotation in one direction relative to the cartridge. The rope is pulled to rotate the spool in the opposite direction, relative to the cartridge, from the direction in which the recoil spring biases the spool for rotation. The cartridge is secured to the engine housing of the power tool on the outer surface of the engine housing. The cartridge is detachable from the engine housing to allow replacement of the starter assembly without requiring disassembly of the engine housing of the power tool.

A starter housing is preferably provided which substantially encloses the cartridge and is secured to the engine housing by removable fasteners. The starter housing also preferably encloses a clutch and clutch drum which interconnects a shaft driven by the internal combustion engine to a driveshaft of an implement upon reaching a predetermined shaft rotating speed. The starter assembly is assembled to the power tool housing between the engine housing and a boom which supports the driveshaft.

These and other objects and advantages of the invention will be more fully understood in view of the attached drawings and detailed description of the invention which follows.

BEST MODE FOR CARRYING OUT THE INVENTION

Figure 1:
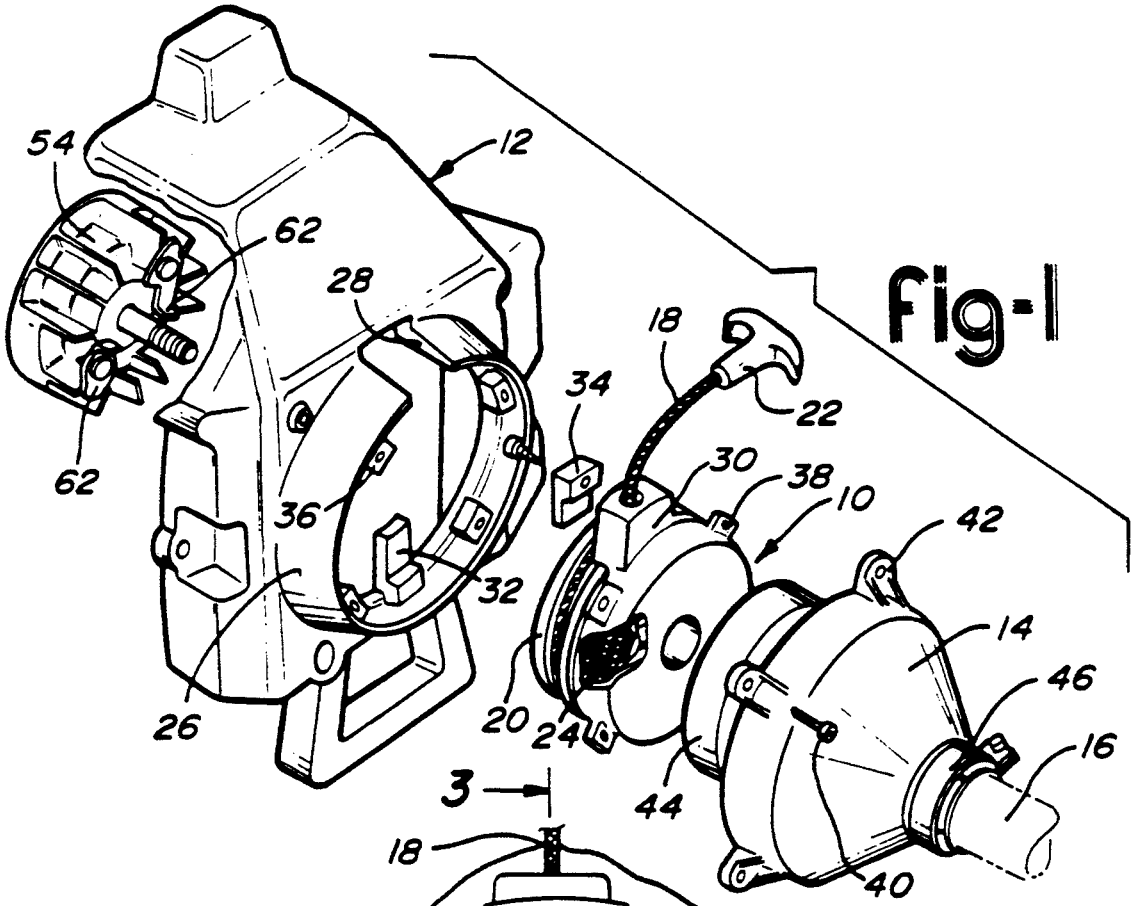
FIG. 1 is an exploded perspective view of a starter assembly cartridge of the present invention as attached to a power tool housing.
Figure 2:
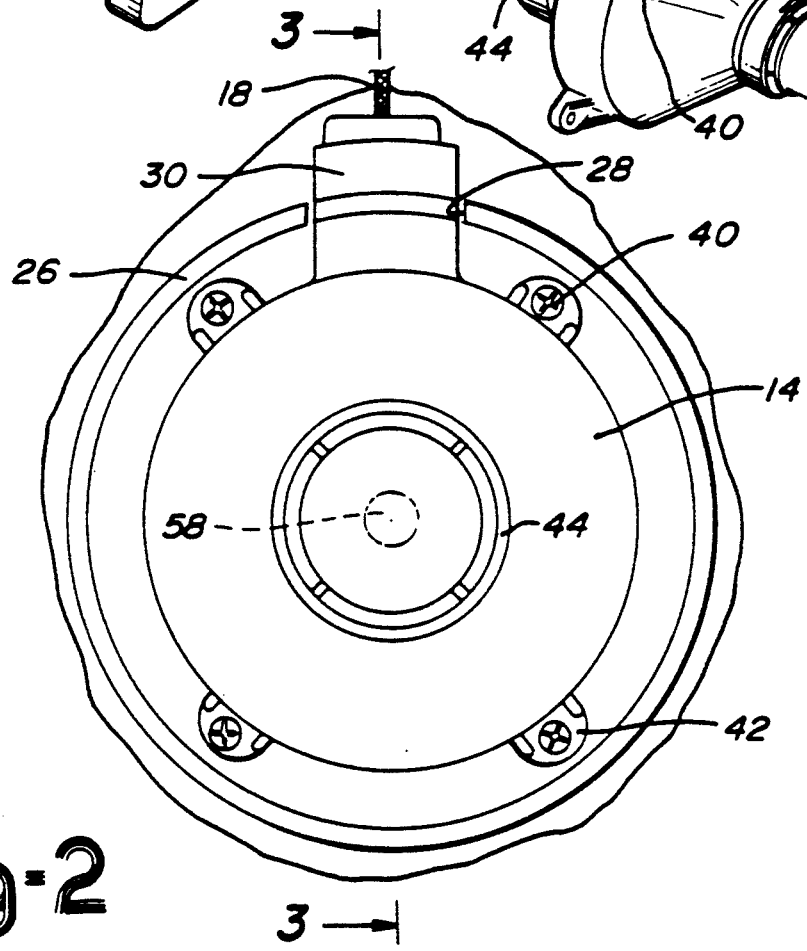
FIG. 2 is a fragmentary front elevational view of a starter housing and power tool housing.

Referring now to FIGS. 1 and 2, a starter assembly cartridge 10 is shown in an exploded perspective view separated from a power tool housing 12 and a starter housing 14. The starter assembly cartridge 10 is housed substantially within the starter housing 14 on the front of the power tool housing 12. A boom 16 is secured within the front portion of the starter housing 14.

A rope 18 is wound about a spool 20 and is secured to a rope handle 22. The spool 20 is biased to rewind the rope 18 by means of a spring 24. Spring 24 is contained within the starter assembly cartridge 10. The starter assembly cartridge 10 is removable from the starter housing 14 without requiring any disassembly of the power tool housing 12. When the starter assembly cartridge 10 is replaced, the rope 18, spool 20 and spring 24 are all replaced as a unit. While it may be possible to repair components of the cartridge 10, if, upon removal, it appears that repairs would be substantial, it is a simple matter to replace the starter assembly cartridge 10 in its entirety.

The cartridge 10 is preferably received within a collar 26 formed on the front of the power tool housing 12. The collar 26 is a generally annular member having a slot 28 in the upper surface thereof as viewed in FIG. 1. A rope guide 30 extending outwardly from the spool 20 and forming an integral part of the cartridge 10 is received within the slot 28. A backstop 32 is secured to the inner lower portion of the collar 26 while a guide backstop 34 is preferably secured to the rope guide 30.

A plurality of seats 36 are preferably formed on the inner diameter of the collar 26. A pair of radially outwardly extending tabs 38 are formed on the cartridge 10 which overlap the seats 36. A plurality of fasteners 40 are inserted through a plurality of feet 42 formed on the starter housing 14 and are used to secure the tabs 38 to the seats 36 when the starter housing 14 is secured to the power tool housing 12. The cartridge 10 is housed substantially by the starter housing 14 and the collar 26.

A clutch 44 and clutch drum 45 are preferably provided within the starter housing 14 adjacent the cartridge 10. The clutch 44 and clutch drum 45 are used to disconnect an implement from an internal combustion engine when rotational speeds drop below a predetermined rate. One embodiment including the clutch 44 and clutch drum 45 are shown in FIG. 3, while a direct drive embodiment which does not include the clutch and clutch drum is shown in FIG. 4.

A clamp 46 is affixed to the forward end of the starter housing 14 to allow the starter housing 14 to be clamped onto the boom 16.

Figure 3:
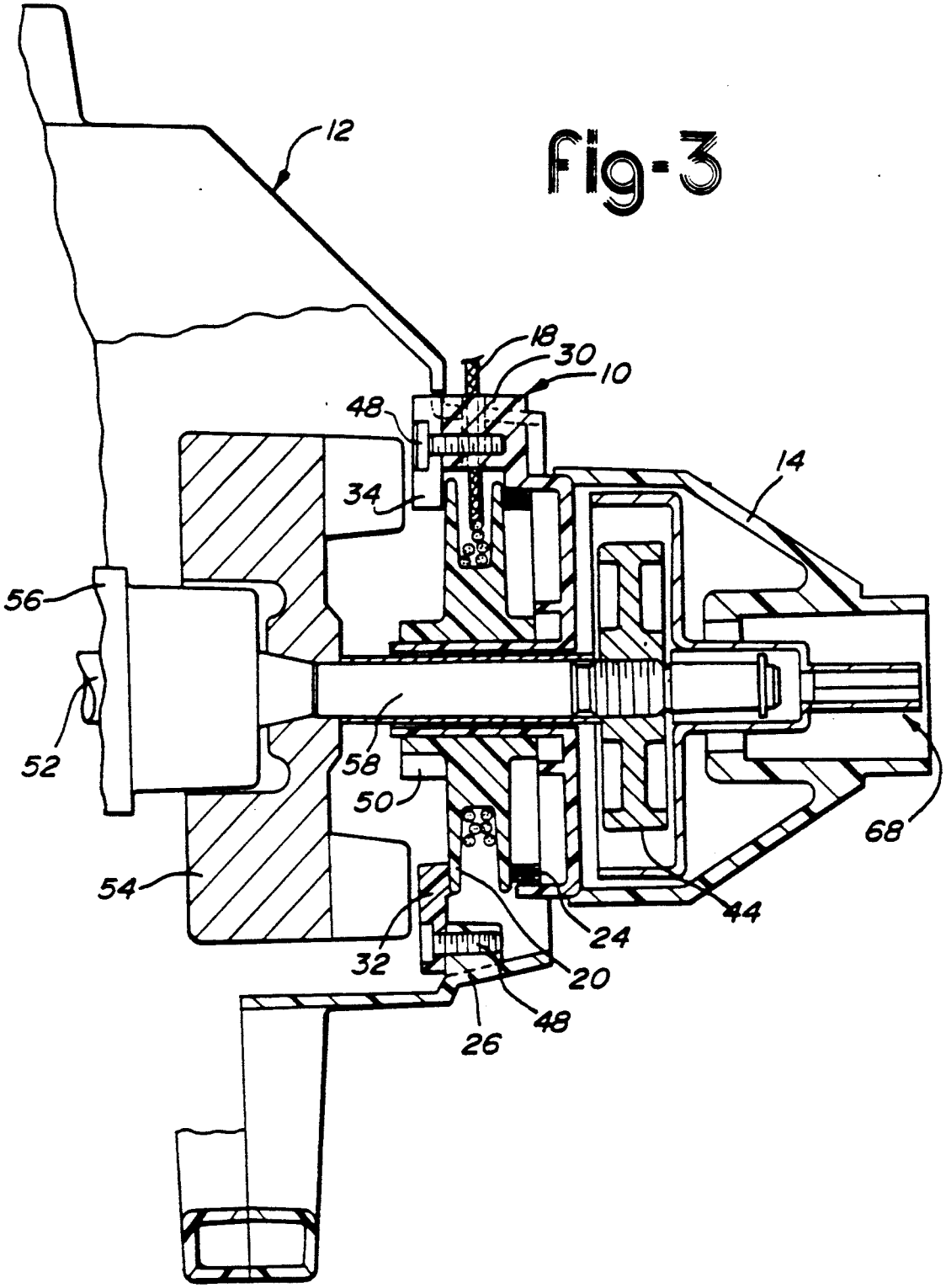
FIG. 3 is a cross-sectional view taken along the line 3—3 in FIG. 2.
Figure 4:
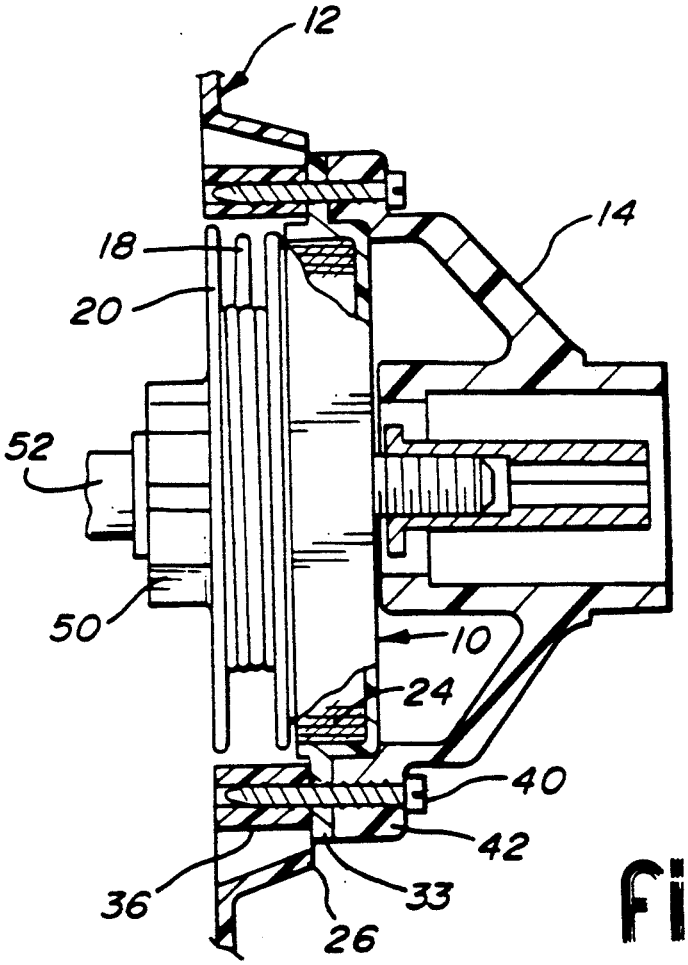
FIG. 4 is a cross-sectional view of the starter assembly cartridge in a starter housing without a clutch.

Referring now to FIG. 3, an embodiment including the clutch 44 and clutch drum 45 are shown in cross-section. The cartridge 10 is shown assembled between the power tool housing 12 and starter housing 14. The pull-start rope 18 is shown coiled on the spool 20 and the spring 24 which biases the rope 18 to recoil itself is also shown. The cartridge 10 is nested within the collar 26 with the rope guide 30 fitted into the slot 28. Backstop 32 and guide backstop 34 are secured by means of backstop fasteners 48 to the collar 26 and starter assembly 10, respectively. The clutch 44 and clutch drum 45 interconnect a power take-off shaft 58 with a receptacle 60 for an implement shaft (not shown).

Also shown in FIG. 3 is a starter gear 50 which is adapted to be engaged by starter dogs 62 which are pinned or otherwise connected in a pivotal arrangement to the flywheel 54 of the internal combustion engine shown fragmentarily and referred to as reference numeral 56. The starter dogs 62, which are not shown in FIG. 3 for clarity, are shown in FIG. 1. The internal combustion engine 56 includes a crankshaft 52 which is preferably driven by a single piston engine. The crankshaft 52 drives an implement shaft (not shown). When the rope 18 is pulled, the spool 20 is rotated so as to cause the starter gear 50 to engage the starter dogs 62 which are secured to the flywheel 54. The flywheel 54 and crankshaft 52 rotate to start the internal combustion engine 56 as is well known in the prior art. In the embodiment including a clutch 44 and clutch drum 45, the receptacle 60 is not driven by the engine until engine rotation speeds exceed a predetermined level. When the clutch 44 engages, the receptacle 60 is driven by the internal combustion engine 56.

Referring now to FIG. 4, an embodiment is shown wherein no automatic clutch is provided. In this embodiment, the cartridge 10 is shown as it is secured to the power tool housing 12 within the starter housing 14. The seats 36 on the inner diameter of the collar 26 are provided to secure the cartridge 10. A plurality of tabs 38 extend outwardly from the cartridge 10 and are sandwiched between feet 42 formed on the starter housing 14 and the seats 36. A fastener 40 is used to secure each of the tabs 38 between the feet 42 and seats 36. The power take-off shaft 58 is received by a drive nut 64 directly within the front opening of the starter housing 14 without an intermediate clutch. The starter gear 50 is engaged by the starter dogs 62, but the elimination of the clutch results in the rotation of the crankshaft 52 and implement shaft (not shown) when the rope is pulled.

The above description of the invention is of two best modes of practicing the invention as presently known to the applicant. The description is intended to be illustrative of the invention and is not to be read in a limiting sense. Other modifications and adaptations of the invention are understood to be possible and should be considered to fall within the scope of the invention as claimed below.

What is claimed is:

1. A replaceable starter assembly for a hand-held internal combustion engine of a power tool having an engine housing and a starter housing removeably secured to the engine housing comprising:

a cartridge substantially enclosed by the starter housing;

a spool mounted on the cartridge for rotation relative to the cartridge;

a recoil spring biasing the spool for rotation in one direction relative to the cartridge;

a rope wound on the spool which is pulled to rotate the spool in the opposite direction relative to the cartridge from said one direction;

said cartridge being secured to the engine housing of the power tool on a surface of the engine housing facing away from the internal combustion engine, said cartridge being detachable from the engine housing of the power tool to allow replacement of the starter assembly without disassembly of the engine housing of the power tool.

2. The starter assembly of claim 1 wherein said starter housing has a clutch drum disposed therein which interconnects a shaft driven by the internal combustion engine to a driveshaft of an implement, said clutch and clutch drum being removable with said starter housing and separable from the cartridge.

3. The starter assembly of claim 1 wherein said cartridge has a cup-shaped body portion which at least partially encloses the spool, said body portion including means for securing said body portion to said engine housing to prevent movement of the body portion relative to the engine housing.

4. The starter assembly of claim 3 wherein said means for securing said body portion to said engine housing is a plurality of feet, each of said feet including an opening through which a fastener is received for securing the body portion to the engine housing.

5. The starter assembly of claim 1 wherein said spool includes a starter gear on one side thereof.

6. A replaceable starter assembly for a hand-held internal combustion engine of a power tool having a housing and a detachable clutch comprising;

a cartridge housing;

a spool mounted on the housing for rotation relative to the housing;

a recoil spring biasing the spool for rotation in one direction relative to the cartridge housing;

a rope wound on the spool which is pulled to rotate the spool in the opposite direction relative to the cartridge housing from said one direction;

said cartridge housing being secured to the housing of the power tool on a surface of the housing facing away from the internal combustion engine, said cartridge housing being enclosed within a clutch housing which is detachable from the housing of the power tool to allow replacement of the starter assembly by removing the clutch housing without removal of the housing of the power tool.

7. The starter assembly of claim 6 wherein a starter housing is provided which substantially encloses the cartridge and is secured to the engine housing by removable fasteners.

8. The starter assembly of claim 7 wherein said starter housing encloses the detachable clutch which interconnects a shaft driven by the internal combustion engine to a driveshaft of an implement.

9. The starter assembly of claim 6 wherein said cartridge is assembled to the power tool housing between the engine housing and a boom which supports the driveshaft of an implement.

10. The starter assembly of claim 6 wherein said cartridge has a cup-shaped body portion which at least partially encloses the spool, said body portion including means for securing said body portion to said engine housing to prevent movement of the body portion relative to the engine housing.

11. The starter assembly of claim 10 wherein said means for securing said body portion to said engine housing is a plurality of feet, each of said feet including an opening through which a fastener is received for securing the body portion to the engine housing.

12. The starter assembly of claim 6 wherein said spool includes a starter gear on one side thereof.

13. A replaceable starter assembly for a hand-held internal combustion engine of a power tool having an engine housing comprising:

a cartridge;

a spool mounted on the cartridge for rotation relative to the cartridge;

a recoil spring biasing the spool for rotation in one direction relative to the cartridge;

a rope wound on the spool which is pulled to rotate the spool in the opposite direction relative to the cartridge from said one direction;

said cartridge being secured to the engine housing of the power tool on a surface of the engine housing facing away from the internal combustion engine, said cartridge being assembled between the engine housing of the power tool and a boom which supports a driveshaft of an implement, said cartridge being detachable from the engine housing of the power tool to allow replacement of the starter assembly without disassembly of the engine housing of the power tool.

* * * * *